US008896638B2

(12) United States Patent
Kurabayashi et al.

(10) Patent No.: US 8,896,638 B2
(45) Date of Patent: Nov. 25, 2014

(54) LIQUID CRYSTAL DISPLAY DEVICE AND BACKLIGHT CONTROL METHOD

(75) Inventors: Hiroyuki Kurabayashi, Yokohama (JP); Yasutaka Tsuru, Yokohama (JP); Yuya Ogi, Yokohama (JP); Kazuhiko Tanaka, Fujisawa (JP); Akihiro Shiraishi, Yokohama (JP)

(73) Assignee: Hitachi Maxell, Ltd., Ibaraki-shi, Osaka (JP)

( * ) Notice: Subject to any disclaimer, the term of this patent is extended or adjusted under 35 U.S.C. 154(b) by 325 days.

(21) Appl. No.: 13/088,207

(22) Filed: Apr. 15, 2011

(65) Prior Publication Data

US 2011/0267379 A1 Nov. 3, 2011

(30) Foreign Application Priority Data

Apr. 28, 2010 (JP) ..... 2010-103355

(51) Int. Cl.
*G09G 5/10* (2006.01)
*G09G 3/34* (2006.01)

(52) U.S. Cl.
CPC ..... *G09G 3/3426* (2013.01); *G09G 2320/0238* (2013.01); *G09G 2320/0653* (2013.01); *G09G 2320/0646* (2013.01); *G09G 2360/16* (2013.01); *G09G 2320/0233* (2013.01); *G09G 2320/0606* (2013.01)
USPC ..... 345/690; 345/691

(58) Field of Classification Search
None
See application file for complete search history.

(56) References Cited

U.S. PATENT DOCUMENTS

2008/0094424 A1* 4/2008 Ebe ..... 345/690
2008/0297463 A1* 12/2008 Tsuru et al. ..... 345/102
2010/0045694 A1 2/2010 Tanaka et al.
2010/0073276 A1* 3/2010 Koike et al. ..... 345/102
2010/0194791 A1 8/2010 Ogi et al.
2010/0225640 A1* 9/2010 Vieri et al. ..... 345/214
2010/0309107 A1 12/2010 Muroi et al.
2011/0249034 A1 10/2011 Nagai

FOREIGN PATENT DOCUMENTS

EP 1 914 711 A1 4/2008
JP 2006-030588 A 2/2006
JP 2006-30588 A 2/2006
JP 2008-176211 A 7/2008
JP 2010-049125 A 3/2010
JP 2010-175913 A 8/2010
JP 2011-221411 A 11/2011
WO WO 2009/101727 A1 8/2009

OTHER PUBLICATIONS

Extended European Search Report issued Jan. 25, 2012, in European Patent Application No. 11162608.1.

* cited by examiner

*Primary Examiner* — Alexander Eisen
*Assistant Examiner* — Nan-Ying Yang
(74) *Attorney, Agent, or Firm* — Miles & Stockbridge P.C.

(57) ABSTRACT

An initial light control value calculation section calculates the backlight's initial light control value K0 according to brightness of an inputted image signal for each area. A black area measurement section measures a black area S by obtaining ratio of the number of pixels satisfying Y≤Y0 (Y: brightness signal level, Y0: black level threshold) in the screen. A minimum light control value output section determines a minimum light control value Kmin based on comparison between the measured black area S and a black area threshold S0 and outputs a maximum value permissible for the light control value as the value Kmin when the black area S is the threshold value S0 or less. An LED control signal calculation section outputs a control signal to LED light sources based on a light control value K1 as the higher one of K0 and Kmin.

7 Claims, 5 Drawing Sheets

LIQUID CRYSTAL DISPLAY DEVICE AND BACKLIGHT CONTROL METHOD

CLAIM OF PRIORITY

The present application claims priority from Japanese patent application serial No. JP 2010-103355, filed on Apr. 28, 2010, the content of which is hereby incorporated by reference into this application.

BACKGROUND OF THE INVENTION

1. Field of the Invention

The present invention relates to a liquid crystal display device which includes a backlight for illuminating a liquid crystal panel (for displaying images) from behind and executes brightness adjustment of the backlight in response to an image signal inputted for the displaying of the images. The present invention relates also to a control method for the backlight.

2. Description of the Related Art

A liquid crystal display device is equipped with a non-emitting liquid crystal panel (light-transmissive optical modulation element) and a backlight arranged behind the liquid crystal panel to illuminate the panel with light, differently from self-emission display devices (CRT (Cathode Ray Tube), plasma display panel, etc.). In general, the liquid crystal display device displays images at desired brightness by controlling the optical transmittance of the liquid crystal panel according to the brightness specified by the image signal while making the backlight's light source (e.g., LED) emit light at a fixed brightness level irrespective of the image signal. Therefore, the electric power consumption of the backlight remains constant without decreasing even when dark images are displayed. This leads to low electric power efficiency of the liquid crystal display device. As a countermeasure against this problem, a well-known technique employs variable brightness of the backlight and reduces the electric power consumption by controlling the grayscale level of the liquid crystal panel and the brightness of the backlight according to the brightness level (luminance level) of the inputted image signal. There also exists a technique known as "area control" or "local dimming", in which the backlight is segmented into multiple areas and the backlight brightness control is conducted for each of the areas.

For example, an image display device disclosed in JP-A-2006-30588, aiming to provide a high-performance ACC (Automatic Contrast Circuit) by controlling the LED backlight brightness in units of pixels, comprises screen information analyzing means which detects average brightness information on the image signal, black level areas and white level areas, and LED backlight control means which controls the brightness of each LED backlight according to a control signal outputted by the screen information analyzing means.

SUMMARY OF THE INVENTION

The aforementioned area control is capable of minimizing the power consumption of the entire backlight since the power consumption can be optimized for each of the areas. However, the execution of the area control can cause deterioration in the image quality depending on the pattern, design, etc. of the image displayed on the screen.

FIG. 6 is a schematic diagram for explaining the dependence of the effect of the area control on the image pattern on the screen. In FIG. 6, the backlight's illuminating surface for illuminating the entire screen (corresponding to the display surface of the liquid crystal panel) is segmented into a plurality of areas arranged in a two-dimensional array (45 areas in this example).

The screen 610 shown in FIG. 6 represents a case where a small white area (white window) 612 exists in a black background 611. By executing the area control in this case, the electric power (power consumption) can be reduced and the contrast can be improved. Specifically, with the increase in the black area in the screen, total reduction of the power consumption increases due to the increase in the number of areas undergoing the reduction of the backlight brightness. By the reduction of the backlight brightness of the black area 611, the so-called "black floating" (graying of black) is reduced and the contrast ratio between the white window 612 and the black area 611 is improved. On the other hand, the reduction of the backlight brightness of the black area 611 increases the possibility of a halo 613 developing around the white window 612 due to the leaking of the brightness of the white window 612 into the surrounding black area 611.

In contrast, the screen 620 shown in FIG. 6 represents a case where a small black area (black window) 622 exists in a white background 621. In this case, the aforementioned effects (power reduction and improvement of contrast) diminish since the number of areas undergoing the reduction of the backlight brightness is small and the visual contrast of the pattern (small black window 622 existing in the large white background 621) is already high. Further, a drop in the brightness of a white background area surrounding the black window 622 becomes a problem in this case since the reduction of the backlight brightness of the black window 622 eliminates light leaking from the black window area to the surrounding white background area. The brightness drop in a bright image significantly deteriorates the image quality in terms of visual perception.

As above, the execution of the area control to a bright image pattern results in significant adverse effect of image deterioration, with little beneficial effect. Therefore, it is desirable to properly execute the area control depending on the pattern of the image, considering the balance between the electric power reduction and the image quality improvement. In the technique of the JP-A-2006-30588, the LED backlight is controlled so as to reduce the brightness (luminance) of signals below a variation point according to the area (size) of the black level areas or to increase the brightness of signals above a variation point according to the area of the white level areas. However, the technique has not taken the balance between the electric power reduction and the image quality improvement into consideration.

It is therefore an object of the present invention to provide a liquid crystal display device and a backlight control method capable of achieving the electric power reduction and the image quality improvement in a well-balanced manner in the area control of the backlight.

In accordance with an aspect of the present invention, there is provided a liquid crystal display device comprising: a liquid crystal panel which displays images, the liquid crystal panel being segmented into a plurality of areas; LED light sources as a backlight which controls brightness of each of the areas independently; an initial light control value calculation section which detects brightness of an inputted image signal in regard to each of the areas and calculates the backlight's initial light control value K0 corresponding to each area according to the detected brightness; a black area measurement section which compares a brightness signal level Y of each pixel in a screen with a black level threshold value Y0 and measures a black area S by obtaining ratio of the number of pixels satisfying $Y \leq Y0$ to the total number of pixels in the screen; a minimum light control value output section which determines and outputs a minimum light control value Kmin based on comparison between the black area S measured by the black area measurement section and a black area threshold value S0; and an LED control signal calculation section which outputs a control signal to the LED light sources based on a light control value K1 as a higher one selected from the initial light control value K0 and the minimum light control value Kmin. The minimum light control value output section outputs a maximum value permissible for the light control value as the minimum light control value Kmin when the black area S is the black area threshold value S0 or less.

Preferably, the minimum light control value output section outputs an intermediate light control value previously set corresponding to the black area S and higher than a minimum value permissible for the light control value as the minimum light control value Kmin when the black area S is larger than the black area threshold value S0.

In accordance with another aspect of the present invention, there is provided a backlight control method for controlling a backlight of a liquid crystal display device, segmenting a liquid crystal panel for displaying images into a plurality of areas and controlling brightness of each of the areas independently, comprising the steps of: detecting brightness of an inputted image signal in regard to each of the areas and calculating a light control value of the backlight corresponding to each area according to the detected brightness; comparing a brightness signal level Y of each pixel in a screen with a black level threshold value Y0 and measuring a black area S by obtaining ratio of the number of pixels satisfying $Y \leq Y0$ to the total number of pixels in the screen; and correcting the calculated light control value according to the measured black area S. The light control values of the backlight are set at a maximum value when the measured black area S is a black area threshold value S0 or less.

By the present invention, a liquid crystal display device and a backlight control method capable of achieving the electric power reduction and the image quality improvement in a well-balanced manner in the area control of the backlight can be provided.

BRIEF DESCRIPTION OF THE DRAWINGS

These and other features, objects and advantages of the present invention will become more apparent from the following description when taken in conjunction with the accompanying drawings wherein.

DESCRIPTION OF THE PREFERRED EMBODIMENTS

Figure 1:
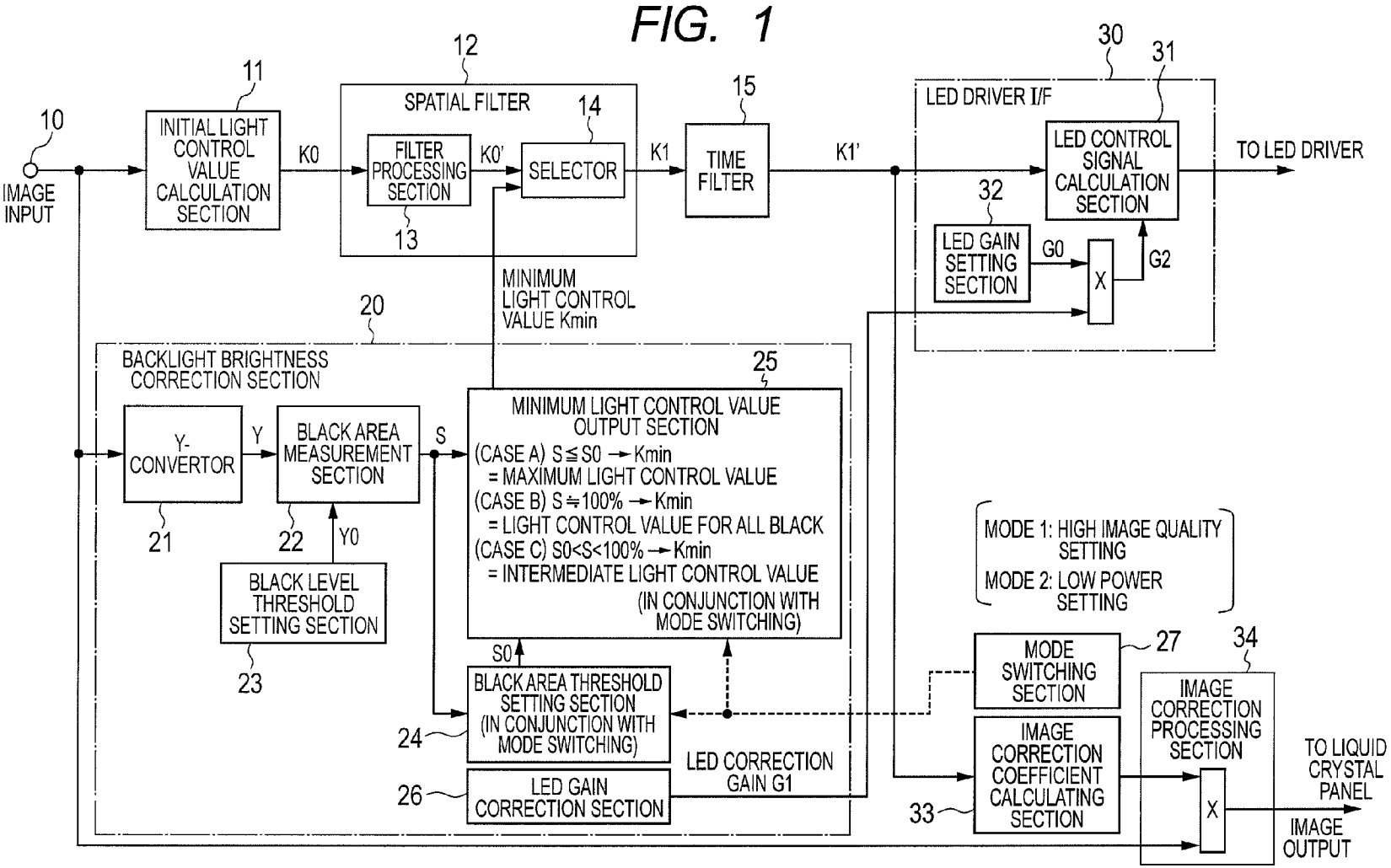
FIG. 1 is a block diagram showing a liquid crystal display device in accordance with an embodiment of the present invention.

Referring now to the drawings, a description will be given in detail of a preferred embodiment in accordance with the present invention. First, the configuration of backlight blocks, corresponding to "areas" of the backlight according to this embodiment, will be explained referring to FIGS. 7 and 8. Specifically, the backlight according to this embodiment is formed by arranging a plurality of backlight blocks in a two-dimensional array.

Figure 6:
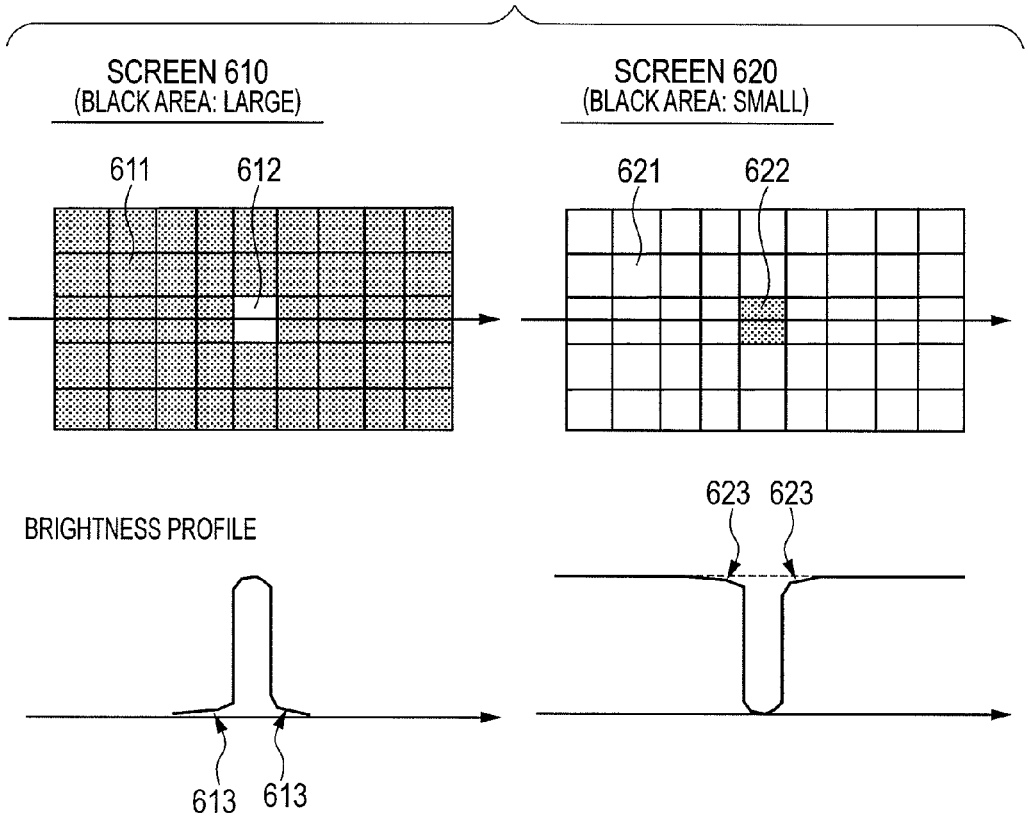
FIG. 6 is a schematic diagram for explaining the dependence of the effect of the area control on the image pattern of the screen.
Figure 7:
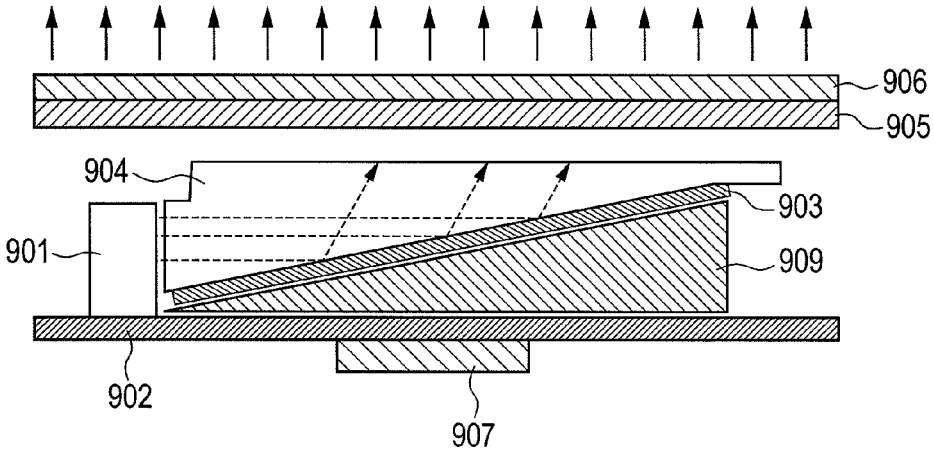
FIG. 7 is a schematic diagram showing an example of the configuration of a backlight block corresponding to each area of the backlight.

FIG. 7 is a schematic diagram showing an example of the configuration of the backlight block corresponding to each area of the backlight (i.e., corresponding to one of the 45 areas shown in FIG. 6, for example). As shown in FIG. 7, for example, each backlight block is equipped with a primary light source 901 (e.g., LED (Light-Emitting Diode)) mounted on a surface of an LED drive circuit board 902 facing a liquid crystal panel 906. On the other surface of the LED drive circuit board 902, an LED driver 907 for supplying driving current to the LED 901 is mounted. The driving current supplied from the LED driver 907 to the LED 901 is controlled by an LED driver I/F 30 which will be explained later. In this example, the LED 901, emitting white light, is implemented by an LED of the so-called side view type which emits light in a direction parallel to the electrode surface of the LED (parallel to the principal plane of the LED drive circuit board 902 in this example). However, it is of course possible to employ an LED of the top view type (emitting light in a direction orthogonal to the electrode surface of the LED) for the LED 901.

On the light-emitting side of the LED 901, a light guide plate 904 for guiding the emitted light (indicated with dotted arrows in FIG. 7) from the LED 901 toward the front (toward the liquid crystal panel 906) is arranged. In this example, it is assumed that multiple LEDs 901 (e.g., three LEDs) aligned in the direction orthogonal to the sheet of FIG. 7 are used for one light guide plate 904. The back face of the light guide plate 904 is provided with a reflecting sheet 903 in order to efficiently reflect the emitted light from the LED 901 (incident upon the light guide plate 904) toward the front. In the space between the reflecting sheet 903 and the LED drive circuit board 902, a supporting member 909, colored white to reflect light, is inserted. This supporting member 909 supports the reflecting sheet 903 and the light guide plate 904 from behind.

As shown in FIG. 7, the cross section of the light guide plate 904 along the plane of FIG. 7 (orthogonal to the liquid crystal panel 906) has a wedge-like shape, with its thickness gradually decreasing from the inlet end face (through which the light enters) to the tip opposing the inlet end face. Further, the back face of the light guide plate 904 is provided with the reflecting sheet 903 as mentioned above. Therefore, the emitted light from the LED 901 entering and traveling through the light guide plate 904 is deflected upward (toward the liquid crystal panel 906) thanks to the wedge shape of the light guide plate 904 and the reflecting function of the reflecting sheet 903. Furthermore, by a diffusing effect of a diffusive reflection pattern on the under surface (facing the reflecting sheet 903) or the light outlet surface (facing the liquid crystal panel 906) of the light guide plate 904, the light is emitted upward (toward the liquid crystal panel 906) as indicated with the dotted arrows in FIG. 7, as planar light achieving a substantially uniform incident light brightness level.

A diffusing plate 905 further diffuses the light emerging from the light guide plate 904, thereby emitting the light toward the liquid crystal panel 906 as planar light that is more spatially uniform. The liquid crystal panel 906, whose optical transmittance is controlled in units of pixels according to the image signal inputted thereto, spatially modulates the light from the diffusing plate 905 and thereby forms an image. By this process, the image light (indicated with upward arrows in FIG. 7) is outputted to the front of the liquid crystal display device.

Incidentally, while LEDs emitting white light are employed as the LEDs 901 in this example, the implementation of the LEDs 901 is not restricted to this example. It is possible, for example, to employ a plurality of LED groups each including a red LED (emitting red light), a green LED (emitting green light) and a blue LED (emitting blue light).

The backlight blocks configured as above are arranged in a two-dimensional array (in the horizontal direction and the vertical direction of the screen) on the back of the liquid crystal panel. Each LED set (three LEDs 901 in this example) provided corresponding to each backlight block is controlled separately. This makes it possible to control the brightness of each area independently of other areas.

Figure 8:
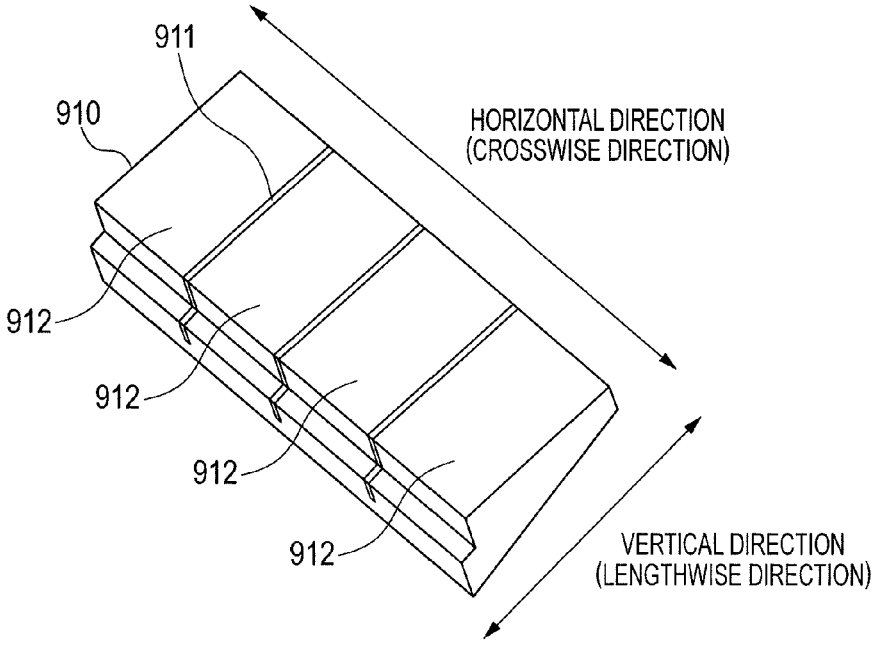
FIG. 8 is a schematic diagram showing an example of a light guide plate employed for the backlight block.

FIG. 8 is a schematic diagram showing an example of the light guide plate employed for the backlight block. While one light guide plate may be used for one light source block (backlight block), it is also possible as shown in FIG. 8 to join and integrate multiple light guide plates (four light guide plates in the example of FIG. 8) aligned in the horizontal direction of the screen (crosswise direction) into one body (integrated light guide plate 910) and employ one integrated light guide plate 910 for four backlight blocks. A light guide plate covering the entire area of the liquid crystal panel is formed by arranging the integrated light guide plates 910 in the horizontal and vertical directions of the screen. In each integrated light guide plate 910, grooves 911 extending in the vertical direction of the screen are formed, by which the integrated light guide plate 910 is segmented into multiple light guide plate blocks 912 corresponding to the light source blocks (backlight blocks), respectively. Although not shown in FIG. 8, the integration of multiple light guide plates may also be done in the vertical direction of the screen.

Next, the area control in accordance with this embodiment will be explained below. FIG. 1 is a block diagram showing an embodiment of the liquid crystal display device for executing the area control according to the present invention. In this liquid crystal display device, the liquid crystal panel for displaying images is segmented into a plurality of areas and a plurality of LED light sources are provided as the backlight in order to control the brightness of each of the areas independently as mentioned above. In FIG. 1, a part for controlling the brightness (LED gain) of the backlight and a part for correcting the image signal supplied to the liquid crystal panel are shown.

As a system for controlling the backlight brightness of each area, the device includes an initial light control value calculation section 11, a spatial filter 12, a time filter 15 and an LED driver I/F (interface) 30. As a system for correcting the image signal for each pixel displayed on the liquid crystal panel, the device includes an image correction coefficient calculating section 33 and an image correction processing section 34. In this embodiment, the device further includes a backlight brightness correction section 20 for analyzing the pattern of the input image and optimally controlling the brightness of the backlight according to a "black area" (the area (size) of the black part(s) of the image pattern) obtained by the analysis.

The operation of each component will be explained below. The initial light control value calculation section 11 detects the signal brightness (intensity) of the image signal (RGB) inputted via an input terminal 10 in regard to each area (e.g., maximum brightness (intensity) in each area) and calculates an initial light control value K0 for each area of the backlight appropriate for the detected brightness. The use of the initial light control value K0 has the following advantage: For an area with low image signal brightness, the light intensity (light control value) of the backlight is reduced while increasing the optical transmittance of the liquid crystal panel correspondingly, by which the electric power (power consumption) is reduced without changing the display brightness at the liquid crystal panel. In the spatial filter 12, a filter processing section 13 applies a lowpass filter to the spatial distribution of the initial light control values K0 of the areas and thereby acquires light control values K0' in which sharp spatial changes in the light control value have been moderated. A selector 14 of the spatial filter 12 compares the light control value K0' after the filtering process with a minimum light control value Kmin outputted by a backlight brightness correction section 20 (explained later), selects the higher value, and outputs the selected value as a light control value K1. The time filter 15 applies a lowpass filter to the time variation of the light control value K1 between frames and thereby acquires a light control value K1' in which sharp temporal changes in the light control value have been moderated.

The LED driver I/F 30 includes an LED control signal calculation section 31. The LED control signal calculation section 31 calculates values of an LED control signal based on the light control values K1' (for the areas) after the time filtering process and an LED maximum level set value G2, and outputs the calculated LED control signal to the LED driver. The LED maximum level set value G2 is obtained by correcting a value G0 of an LED gain setting section 32 (LED gain setting value which is set in conjunction with the screen brightness adjustment by the user) by multiplying it (G0) by an LED correction gain G1 outputted by the backlight brightness correction section 20 (explained below).

The backlight brightness correction section 20, which is a component especially characteristic of this embodiment, analyzes the pattern of the input image for one screen (one frame or one field), thereby calculates the black area (the area of black parts of the pattern), and controls the light control values of the backlight and the LED gains according to the calculated black area. In the backlight brightness correction section 20, a Y-convertor 21 converts the inputted RGB signal into a brightness signal (luminance signal) Y. A black area measurement section 22 compares the brightness signal level (luminance signal level) Y for each pixel in the screen with a black level threshold value Y0, judges that the pixel is "black" if the brightness signal level Y is the threshold value Y0 or less, and calculates or measures the proportion (occupancy ratio) of the pixels judged to "black" in one screen of image signal (black area). The black level threshold value Y0 is set by a black level threshold setting section 23.

A minimum light control value output section 25 determines the aforementioned minimum light control value Kmin by comparing the black area S measured by the black area measurement section 22 with a black area threshold value S0. Specifically, if the black area S is the threshold value S0 or less, the maximum value permissible for the light control value is given as the minimum light control value Kmin (case A). If the black area S corresponds to the entire screen, a light control value for "all black" is given as the minimum light control value Kmin (case B). If the black area S is between the threshold value S0 and the value representing the entire screen, an intermediate light control value previously set corresponding to the black area S (higher than the minimum value permissible for the light control value) is given as the minimum light control value Kmin (case C). In other words, in this embodiment handling an image including "black" pixels and pixels in other levels of grayscale, the aforementioned area control (backlight brightness control for each of the areas) is set at OFF in the case A since the black area is small and the effect of the area control is expected to be small. In the case C, the area control is set at ON since the black area is large and the effect of the area control is expected to be probable and significant.

Incidentally, the black area threshold value S0 is set by a black area threshold setting section 24 variably in conjunction with a mode switching section 27. The intermediate light control value used in the case C is also set variably in conjunction with the mode switching section 27. The minimum light control value Kmin determined as above is outputted to the selector 14 of the spatial filter 12 for the selection of the higher value. Therefore, the light control values K1 outputted by the selector 14 do not fall below the minimum light control value Kmin.

An LED gain correction section 26 calculates the value of the LED correction gain signal G1 based on the black area S measured by the black area measurement section 22 and outputs the calculated LED correction gain signal G1 to the LED driver I/F 30.

The image correction coefficient calculating section 33 calculates an image correction coefficient (to be used for compensating for the alteration of the light control value) based on the light control value K1' supplied from the time filter 15. The image correction processing section 34 multiplies the inputted image signal by the image correction coefficient and supplies the multiplied image signal to the liquid crystal panel. This allows the liquid crystal panel to display the image at the original brightness in spite of the alteration of the light control values (light intensity) of the backlight.

The mode switching section 27 switches a control mode of the liquid crystal display device between two modes according to the user's selection (preference). One is "high image quality setting" (mode 1) for properly reducing the electric power (power consumption) while preventing the image quality deterioration, and the other is "low power setting" (mode 2) for maximizing the power reduction by using the area control as much as possible.

Figure 2:
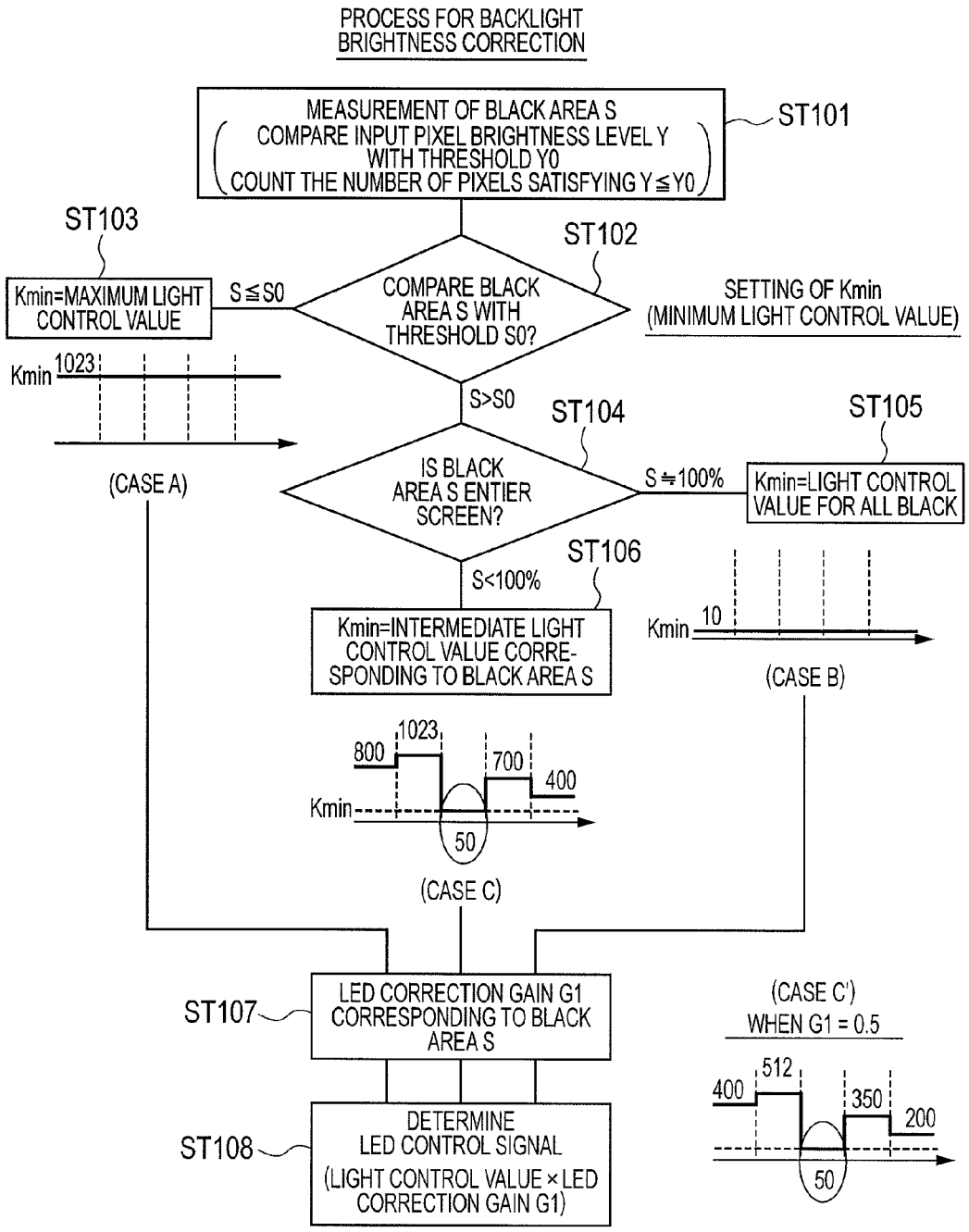
FIG. 2 is a flow chart showing the operation of a backlight brightness correction section.

FIG. 2 is a flow chart showing the operation of the backlight brightness correction section 20. The operation will be explained below in the order of steps. In step ST101, the black area S of the screen is measured. Specifically, the brightness level Y of each pixel (specified by the input signal) is compared with the black level threshold value Y0 and the number of pixels satisfying $Y \leq Y0$ (i.e., the number of black pixels) is counted. The black area S is measured (determined) by calculating the ratio of the number of black pixels to the total number of pixels in the screen.

In step ST102, the measured black area S is compared with the black area threshold value S0. If $S \leq S0$, the process advances to step ST103, in which the maximum value permissible for the light control value (e.g., grayscale level 1023) is given as the minimum light control value Kmin (case A). This means that the area control is set at OFF (stopped) even if there exists a black part in the screen, by maximizing corresponding light control values.

If $S > S0$, the process advances to step ST104, in which whether the black area S corresponds to the entire screen (S=100%) or not is judged. This judgment may be made employing a certain permissible range (e.g., judging black area S of 95% or more to correspond to the entire screen). If the black area S corresponds to the entire screen, the process advances to step ST105, in which a preset light control value for "all black" (e.g., grayscale level 10) is given as the minimum light control value Kmin (case B).

If the black area S belongs to neither of the above cases A and B ($S0 < S < 100\%$), the process advances to step ST106, in which an intermediate light control value corresponding to the black area S is given as the minimum light control value Kmin (case C). In the example of FIG. 2, the minimum light control value Kmin in the case C is set at 50. Thus, even when a black part exists in the screen, the light control values for the black part are prevented from falling below the minimum value 50). The intermediate light control value is previously set and stored for each value of the black area S. When the exact value corresponding to the measured black area S is not found, the intermediate light control value is properly determined by means of linear interpolation. Concrete examples of the minimum light control value Kmin will be described later.

In step ST107, the LED correction gain G1 is outputted corresponding to the measured black area S. In step ST108, the LED control signal is determined by multiplying the light control values K1' (determined in the aforementioned process) by the LED maximum level set value G2 obtained by multiplying (correcting) the LED gain setting value G0 (in conjunction with the screen brightness adjustment by the user) by the outputted LED correction gain G1. In the example of FIG. 2, G1=0.5 is applied to the light control values in the case. C and an LED control signal (case C'), uniformly reducing the light control value of each area by half, is generated. The LED correction gain G1 is previously set and stored for each value of the black area S. When the exact value corresponding to the measured black area S is not found, the LED correction gain G1 is properly determined by means of linear interpolation. A concrete example of the LED correction gain G1 will be described later.

Figure 5:
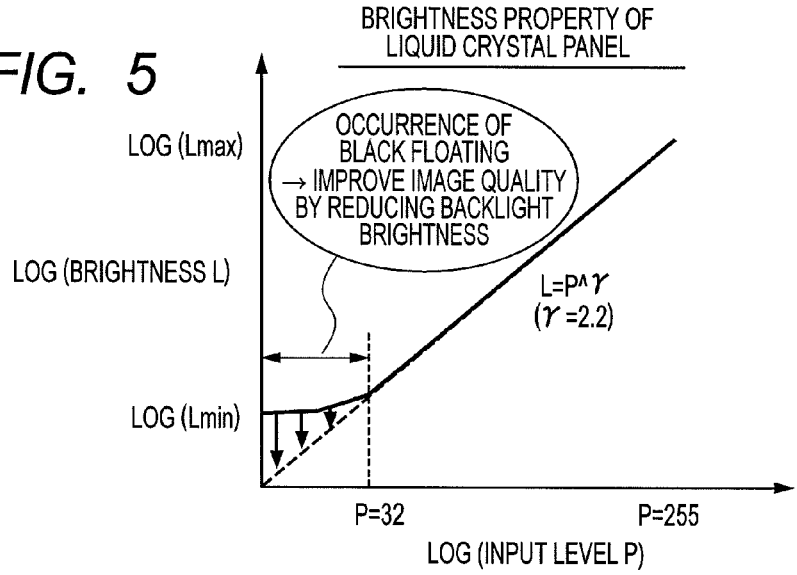
FIG. 5 is a graph showing the general brightness property of a liquid crystal panel.

Here, the aforementioned "black floating" as a problem with the liquid crystal panel will be explained briefly. FIG. 5 is a graph showing the general brightness property of the liquid crystal panel. The relationship between the input level P and the display brightness L in the liquid crystal panel is approximated as $L = \hat{P}\gamma$. In a logarithmic graph (with logarithmic axes), the relationship between log L and log P is represented by a straight line with a gradient γ. In the actual liquid crystal panel, however, the brightness L in a low level zone (where the input level P is low) tends to be higher (brighter) than the straight line. This is the phenomenon called "black floating", causing deterioration in the contrast. Therefore, it is possible to suppress the black floating and improve the contrast by reducing the backlight brightness in the areas where the black floating occurs.

Also in this embodiment, the initial light control value calculation section 11 makes the correction of reducing the light control value in the low level zone (where the input level P is low) in order to prevent the black floating. It is possible to employ a boundary value of the area where the black floating occurs (input grayscale level=32 in this case) as the black level threshold value Y0 used by the black area measurement section 22.

Figure 3A:
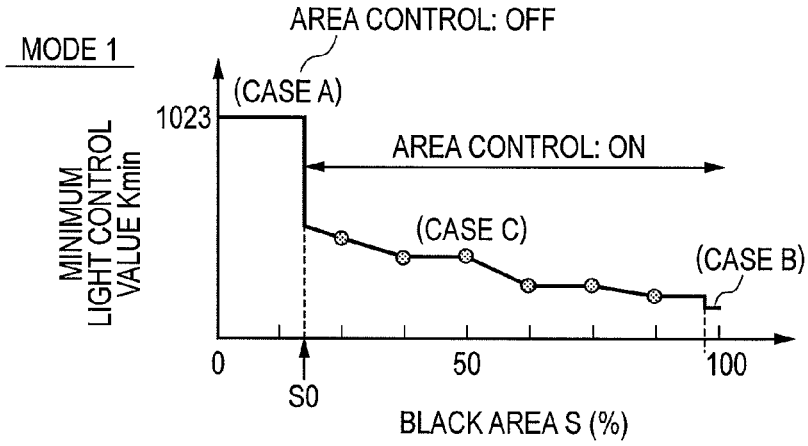
FIGS. 3A and 3B are graphs showing concrete examples of a minimum light control value Kmin corresponding to a black area S.
Figure 3B:
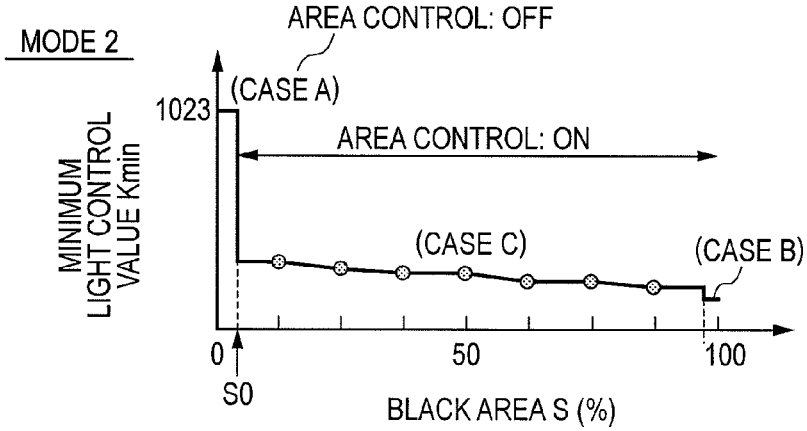

FIGS. 3A and 3B are graphs showing concrete examples of the minimum light control value Kmin corresponding to the black area S. FIGS. 3A and 3B explain how the minimum light control value Kmin is set for each of the two modes.

When the black area S is the black area threshold value S0 or less, the area control is set at OFF by setting the minimum light control value Kmin at the maximum light control level (Kmin=1023) (case A). When the black area S corresponds to the entire screen (S=95% or more), the minimum light control value Kmin is set at the light control value for all black (Kmin=10) (case B). When the black area S is in between the cases A and B (S0<S<95%), the minimum light control value Kmin is set variably using the intermediate light control value previously set corresponding to the black area S (case C).

The black area threshold value S0 is set high (approximately 20%) in the mode 1 (high image quality setting) and low (approximately 5%) in the mode 2 (low power setting). By this setting, the area control is set at ON in a wider range in the mode 2, achieving a larger power reduction in the mode 2. The minimum light control value Kmin in the case C is set higher in the mode 1 than in the mode 2. This is for suppressing the image quality deterioration caused by the development of the aforementioned halo by the high setting of the minimum light control value Kmin. Further, the minimum light control value Kmin is decreased with the increase in the black area S. This is for preventing the image quality deterioration due to the black floating from standing out with the increase in the black area S. By these settings, the liquid crystal display device in the mode 1 (high image quality setting) achieves the electric power reduction properly while preventing the image quality deterioration caused by the area control.

Figure 4:
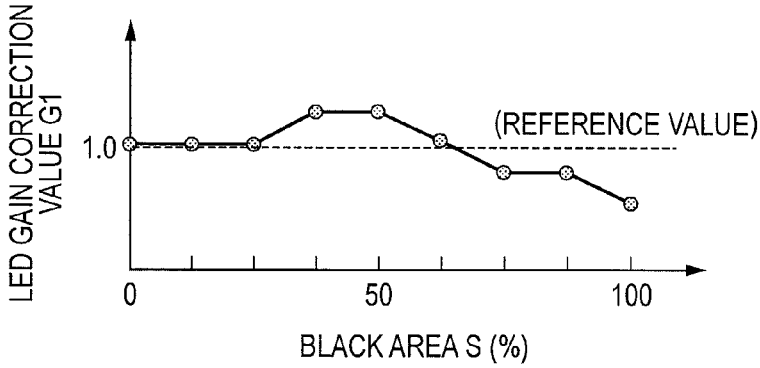
FIG. 4 is a graph showing a concrete example of an LED correction gain G1 corresponding to the black area S.

FIG. 4 is a graph showing a concrete example of the LED correction gain G1 corresponding to the black area S. The LED correction gain G1 is set identically for the two control modes.

The gain G1 is set higher than 1 (reference value) in an intermediate range (30-50%) of the black area S and is reduced below 1 (reference value) as the black area S increases further (70-100%). This is for improving the brightness when the black area S is in the intermediate range while preventing the halo from standing out (by compressing the brightness difference) when the black area S increases further.

As above, the electric power reduction and the image quality improvement can be achieved in a well-balanced manner by changing and adjusting not only the light control value but also the LED correction gain G1 corresponding to the black area S. Incidentally, the conditions of the control (numerical values, etc.) described in the above embodiment are just an example for illustration. The control conditions may of course be changed properly adapting to the performance of the liquid crystal display device as the target of the control.

What is claimed is:

1. A liquid crystal display device comprising:

a liquid crystal panel;

a backlight which illuminates the liquid crystal panel with light, the backlight being segmented into a plurality of areas;

a control section which controls intensity of the light emitted from the backlight, the control section executing area control for controlling the light intensity of each area based on brightness of an image signal corresponding to the area; and a detection section which detects a proportion of image signals at a predetermined brightness level or less to image signals for one screen based on the image signals for one screen, wherein:

(a) one of a first control mode and a second control mode can be selected by a user;

(b) a first predetermined value and a second predetermined value are set corresponding to the first control mode and the second control mode, respectively; and (c) when the first control mode is selected, the control section stops the area control by setting the light intensity of each area of the backlight at a maximum value when the proportion detected by the detection section is the first predetermined value or less, and when the second control mode is selected, the control section stops the area control by setting the light intensity of each area of the backlight at a maximum value when the proportion detected by the detection section is the second predetermined value or less.

2. A liquid crystal display device according to claim 1, wherein the control section controls the backlight so as to maintain the light intensity of each area above 0 even when the brightness of the image signal corresponding to the area is 0.

3. A backlight control method for controlling a backlight of a liquid crystal display device, segmenting a liquid crystal panel for displaying images into a plurality of areas, and controlling brightness of each area independently, the method comprising the steps of:

detecting the brightness of an inputted image signal for each area and calculating a backlight light control value corresponding to each area based on the detected brightness;

comparing a brightness signal level Y of each pixel in a liquid crystal panel screen with a black level threshold value Y0 and measuring a black area S by obtaining a ratio of the number of pixels satisfying $Y \leq Y0$ to the total number of pixels in the screen; and correcting the calculated light control value according to the measured black area S, wherein:

(a) one of a first control mode and a second control mode can be selected by a user;

(b) a first threshold value S1 and a second threshold value S2 are set corresponding to the first control mode and the second control mode, respectively;

(c) when the first control mode is selected, the light control value of the backlight is set at a maximum value when the measured black area S is the first threshold value S1 or less, and when the second control mode is selected, the light control value of the backlight is set at a maximum value when the measured black area S is the second threshold value S2 or less.

4. The backlight control method according to claim 3, wherein when the measured black area S is larger than a black area threshold value S0, a minimum light control value Kmin as a lower limit of the light control value of the backlight is set at a previously set intermediate light control value corresponding to the black area S which is higher than a minimum value permissible for the light control value.

5. The backlight control method according to claim 3, wherein the light control value of the backlight is set so as to maintain the light intensity of each area above 0, even when the brightness of the image signal corresponding to the area is 0.

6. A liquid crystal display device comprising:

a liquid crystal panel;

a backlight which illuminates the liquid crystal panel with light, the backlight being segmented into a plurality of areas;

a control section which controls intensity of the light emitted from the backlight, the control section executing area control for controlling the light intensity of each area based on brightness of an image signal corresponding to the area; and a detection section which detects a proportion of image signals at a predetermined brightness level or less to image signals for one screen based on the image signals for one screen, wherein:

(a) one of a first control mode and a second control mode can be selected by a user;

(b) a first predetermined value and a second predetermined value are set corresponding to the first control mode and the second control mode, respectively; and (c) when the first control mode is selected, the control section sets the light intensity of all areas at a maximum value when the proportion detected by the detection section is the first predetermined value or less, and when the second control mode is selected, the control section sets the light intensity of all areas at a maximum value when the proportion detected by the detection section is the second predetermined value or less.

7. A liquid crystal display device according to claim 1, wherein the first control mode is used for a high image quality setting, the second control mode is used for a low power setting, and the first predetermined value is larger than the second predetermined value.

* * * * *